US006253686B1

(12) United States Patent
Koelsch

(10) Patent No.: US 6,253,686 B1
(45) Date of Patent: Jul. 3, 2001

(54) POWER PULLER MOTOR BOGIE

(75) Inventor: Eric Koelsch, Le Creusot Cedex (FR)

(73) Assignee: Alstom Transport SA, Paris (FR)

( * ) Notice: Subject to any disclaimer, the term of this patent is extended or adjusted under 35 U.S.C. 154(b) by 0 days.

(21) Appl. No.: 09/423,080

(22) PCT Filed: Mar. 1, 1999

(86) PCT No.: PCT/FR99/00452

§ 371 Date: Nov. 2, 1999

§ 102(e) Date: Nov. 2, 1999

(87) PCT Pub. No.: WO99/44875

PCT Pub. Date: Sep. 10, 1999

(30) Foreign Application Priority Data

Mar. 2, 1998 (FR) ..... 98 02473

(51) Int. Cl.[7] ..... B61F 3/00

(52) U.S. Cl. ..... 105/182.1; 105/131; 105/133; 105/136; 105/158.2

(58) Field of Search ..... 105/182.1, 133, 105/96, 199.5, 199.1, 135, 193, 202, 208.1, 131, 136, 138, 139, 158.2

(56) References Cited

U.S. PATENT DOCUMENTS 3,135,224 * 6/1964 McLean ..... 105/136
3,523,505 * 8/1970 Lich ..... 105/182.1
4,046,080 * 9/1977 Dieling et al. ..... 105/133
4,170,945 * 10/1979 Kayserling ..... 105/133
4,228,739 * 10/1980 Fitzgibbon ..... 105/136
4,526,107 * 7/1985 Mautner et al. ..... 105/133
4,542,699 * 9/1985 Smith ..... 105/131
4,787,318 * 11/1988 Vogel ..... 105/136
5,119,736 * 6/1992 Chiodi ..... 105/158.2
5,205,220 * 4/1993 Wallace ..... 105/182.1

FOREIGN PATENT DOCUMENTS 26 57 447 6/1978 (DE) .
0 444 016 8/1991 (EP) .
0 589 866 3/1994 (EP) .

* cited by examiner

*Primary Examiner*—S. Joseph Morano
*Assistant Examiner*—Lars A. Olson
(74) *Attorney, Agent, or Firm*—Sughrue, Mion, Zinn, Macpeak & Seas, PLLC

(57) ABSTRACT

The invention concerns a power puller motor bogie comprising at least a gear motor (6, 10) arranged inside the bogie chassis (4), said gear motor (6, 10) being suspended in said bogie chassis (4) by means of at least two elastic connecting rods (7, 8, 9). Said elastic connecting rods (7, 8, 9) are all supported by said bogie chassis (4). Said elastic connecting rods (7, 8, 9) are such that said suspended gear motor (6, 10) is transversely mobile relative to said vehicle longitudinal direction of movement acts as inertia damper. A shock absorber (12) is fixed between said bogie chassis (4) and said gear motor (6, 10).

7 Claims, 1 Drawing Sheet

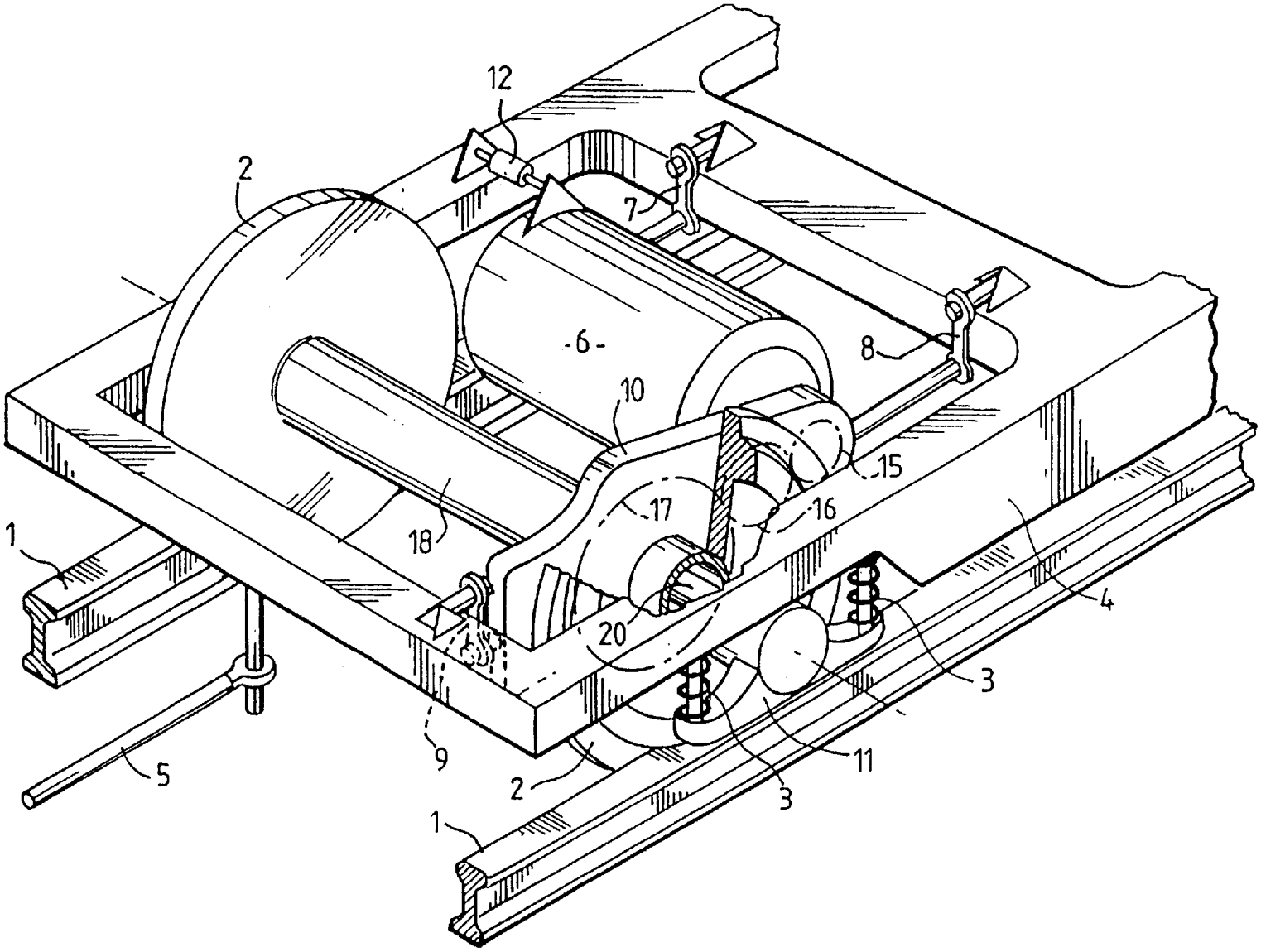
1
2
5
12
7
8
-6-
10
18
15
16
17
20
9
4
3
11
3
2
1

POWER PULLER MOTOR BOGIE

BACKGROUND OF THE INVENTION

The present invention relates to a traction unit, particularly a rail vehicle traction unit, comprising at least one chassis bogie in which at least one geared motor unit is arranged, and relates more specifically to a traction unit drive bogie.

The bogie of a railway vehicle executes lateral movements of translation and rotational movements, known by the name of sinusoidal travel, even on a perfectly straight and flat track. The forces exerted by this sinusoidal travel on the bogie chassis and the frequencies of the resulting oscillations increase with the speed of the vehicle.

Added to these forces are the forces which are due to imperfections in the track, to jolts caused by these imperfections, to points and to curves, these forces being the cause of instability phenomena.

Because of these phenomena of instability, the speed of a vehicle fitted with such a bogie has, for safety reasons, not to exceed a speed known as the critical speed.

The speed which is known as the critical speed is the speed at which the natural frequency of the bogie is close to resonance. The frequency at which the bogie vibrates is all the higher, the higher the speed of travel of the vehicle.

It is essential, in vehicles intended to run at high speed, particularly in railway vehicles, for the so-called critical speed to be raised as high as possible by special structural arrangements so as to allow stable running.

For this reason, it is advantageous for a drive bogie to have a very low unsuspended mass so that its moment of inertia is low in comparison with the translational movement perpendicular to the direction of travel and with respect to rotations about its vertical axis.

In known traction units which are in use in very high numbers, the geared motor unit is fixed rigidly in the bogie chassis. A shaft which is preferably hollow in such cases advantageously transmits energy from the reduction gearset to the wheels via the axle.

The instability phenomena are therefore particularly sensitive as the mass of the motor and of the transmission increase the unsuspended mass of the bogie. This assembly cannot therefore be used for vehicles which have to run at high speed.

There are other rail traction units which are intended for high speeds and whose unsuspended bogie mass is reduced by fixing the motor and the transmission not to the bogie but to the chassis of the body of the vehicle.

A cardan shaft transmits energy from the reduction gearset to the wheels driven via a second gearset mounted on the axle. The lengthening and shortening of these telescopic cardan shafts introduce frictional forces which are a function of the torque that is to be transmitted and which retard the movement. Furthermore, the weight of the telescopic shaft is necessarily higher than an undivided cardan shaft.

SUMMARY OF THE INVENTION

The object of the invention is to provide a traction unit drive bogie as specified, but improved in such a way that the lateral displacements of the bogie chassis are limited and that the so-called critical speed is increased.

According to an essential feature of the invention, the geared motor unit is suspended in the bogie chassis from three elastic connecting rods in such a way that it has enough mobility transversely to the longitudinal direction of travel of the vehicle that it can act as an inertia damper. A shock absorber fixed between the bogie chassis and the geared motor unit absorbs the vibrations of the geared motor unit.

The principle of the invention is based on the fact that the lateral displacements of the geared motor unit and the inertias involved act as a damper, particularly during high speed travel or when running over a jolt, such as points for example.

What happens is that the bogie chassis then, as mentioned earlier, experiences lateral jolts likely to cause the vehicle to become unstable and become derailed.

By virtue of the invention, the inertia and the elastic transverse displacement of the geared motor unit in the bogie chassis oppose the displacements of the bogie chassis under the effect of the jolts. Thus, the geared motor unit damps these displacements by virtue of a phase shift between the displacements of the bogie chassis and those of the geared motor unit. The vibration shock absorber lessens the inherent movements of the geared motor unit.

Another advantage of the drive bogie according to the invention is the complete independence of the bogie, both as regards mechanical interfaces and as regards dynamic couplings in alignment and in rotation between the body and the bogie, unlike certain systems in which part of the geared motor unit is suspended beneath the body.

The drive bogie of the invention may also meet at least one of the following characteristics:

- the said geared motor unit can move in translation transversely to the longitudinal direction of travel of the said traction unit in order to act as an inertia damper,
- the said geared motor unit can move in translation with a lateral travel of at least 30 mm,
- the said geared motor unit is suspended from the said bogie chassis by one connecting rod on the axle side, and is suspended from the said bogie chassis by two connecting rods on the motor side,
- the said geared motor unit is suspended from the said bogie chassis by two connecting rods on the axle side, and is suspended from the said bogie chassis by one connecting rod on the motor side.

The invention also relates to a traction unit which comprises at least one drive bogie as defined above.

Other objects, features and advantages of the invention will become clear from reading the description of a preferred embodiment of the traction unit drive bogie, the description being made in conjunction with the single figure which is a partial perspective view, partly depicted diagrammatically and partly in section, of a drive bogie for a high speed heavy rail vehicle according to the invention, the geared motor unit being suspended and arranged in the bogie chassis via three connecting rods,

BRIEF DESCRIPTION OF THE DRAWING

The single figure is a perspective view of a track unit drive bogie embodying the invention.

DETAILED DESCRIPTION OF THE INVENTION

The single FIGURE illustrates a track 1 on which two drive wheels 2 are placed. An axle 20 connects the drive wheels 2.

A bogie chassis 4 bears via springs 3 on axle boxes 11.

A tie bar 5 arranged at the middle of the bogie chassis provides a connection between the bogie chassis and the body.

A geared motor unit 6, 10 including a motor 6 and reduction gearing 10 is arranged inside the bogie chassis 4.

The geared motor unit 6, 10 is suspended from the bogie chassis 4 by three elastic connecting rods 7, 8, 9.

The connecting rods 7, 8, 9 are articulated to the chassis 4 and to the geared motor unit 6, 10 about axes which are parallel to the direction of travel or the longitudinal direction of the bogie chassis 4. This direction of travel corresponds to the direction of the track 1.

The connecting rods 7, 8, 9 are roughly the same length. The connecting rod 9 is aligned in the longitudinal direction with the connecting rod 8.

The connecting rods 7 and 8 are arranged more or less at the same level in one same plane orthogonal to the longitudinal direction.

The geared motor unit 6, 10 can thus move transversely to the longitudinal direction, that is to easy in a plane roughly orthogonal thereto, to a relatively large extent, by rotary translation.

The reduction gearing 10 is clamped on the motor 6 and comprises a pinion 15 attached to the drive shaft, an intermediate wheel 16 and a ring gear 17 which are depicted diagrammatically.

A hollow transmission shaft 18 transmits the rotational energy of the ring gear 17 directly to the axle 20.

A shock absorber 12, oriented transversely to the longitudinal direction, is fixed between the bogie chassis 4 and the geared motor unit 6, 10.

When a vehicle fitted with a bogie formed in this way runs along the track 1, the chassis 4 experiences transverse loadings, for example under the effect of jolts, which tend to bring about transverse displacements of the chassis 4 as mentioned in the, preamble of the description.

In the bogie according to the invention, the geared motor unit 6, 10 will automatically translate in the opposite direction to the transverse displacements that the chassis 4 would tend to experience.

It is thus found that in use the geared motor unit 6, 10 oscillates transversely in phase opposition to the bogie chassis 4.

The geared motor unit 6, 10 thus acts as an inertia damper, thereby limiting the transverse displacements of the chassis 4 and thus increasing the so-called critical speed of the bogie and of the vehicle fitted with it. The freedom of movement of the geared motor unit 6, 10 in transverse translation must be great enough that its transverse movements are capable of limiting those of the chassis 4.

Typically, the geared motor unit 6, 10 can translate by 15 mm on each side of a position of rest in which the connecting rods 7, 8 and 9 are vertical. Thus, the geared motor unit 6, 10 can translate with an overall lateral travel of 30 mm.

The shock absorber 12 absorbs the inherent vibrations of the geared motor unit 6, 10 which are due, in particular, to its operation.

What is claimed is:

1. A traction unit drive bogie comprising at least one geared motor unit (6, 10) arranged inside a bogie chassis (4), said geared motor unit (6, 10) being suspended in said bogie chassis (4) using at least two elastic connecting rods (7, 8, 9), the bogie being characterized in that said elastic connecting rods (7, 8, 9) all are connected to said bogie chassis (4), in that the bogie comprises a shock absorber fixed between the bogie chassis and the geared motor unit, and in that said elastic connecting rods (7, 8, 9) are such that said suspended geared motor unit (6, 10) moves in translation transversely to a longitudinal direction of travel of the traction unit, and oscillates transversely in phase opposition to the bogie chassis and thus act as an inertia damper.

2. The drive bogie according to claim 1, in which the geared motor unit (6, 10) can move in translation with a lateral travel of at least 30 mm.

3. The drive bogie according to claim 1, in which said geared motor unit (6, 10) is suspended from said bogie chassis (4) by one connecting rod (9) on an axle (20) side of said bogie chassis, and is suspended from said bogie chassis (4) by two connecting rods (7, 8) on a motor (6) side of said bogie chassis.

4. The drive bogie according to claim 1, in which said geared motor unit (6, 10) is suspended from said bogie chassis (4) by two connecting rods (7, 8) on an axle side of said bogie chassis, and is suspended from said bogie chassis (4) by one connecting rod (9) on a motor (6) side of said bogie chassis.

5. A traction unit comprising at least one drive bogie according to claim 1.

6. A traction unit comprising at least one drive bogie according to claim 3.

7. A traction unit comprising at least one drive bogie according to claim 4.

* * * * *